United States Patent [19]

Kincheloe

[11] 4,162,648

[45] Jul. 31, 1979

[54] APPARATUS FOR CONVERTING A CARTON OR THE LIKE INTO A PRESELECTED CONFIGURATION

[76] Inventor: Jack D. Kincheloe, 1620 E. Sierra, Fresno, Calif. 93710

[21] Appl. No.: 843,067

[22] Filed: Oct. 17, 1977

[51] Int. Cl.[2] ..... B31D 5/00

[52] U.S. Cl. ..... 93/1 G; 93/58 H; 229/8; 46/11

[58] Field of Search ..... 33/1 F, 1 G, 174 G; 46/1 L, 11, 24; 93/1 R, 36 R, 36 M, 37 SP, 58 R, 58 H; 206/431; 229/8, 17 G, 52 B

[56] References Cited

U.S. PATENT DOCUMENTS

| | | | |
|---|---|---|---|
| 1,932,368 | 10/1933 | Bowman | 46/37 |
| 2,810,503 | 10/1957 | Krueger | 220/85 H |
| 3,044,211 | 7/1962 | Palm | 46/11 |
| 3,069,979 | 12/1962 | Charles et al. | 93/37 SP |
| 3,190,532 | 6/1965 | Marsh | 229/8 |
| 3,397,623 | 8/1968 | Forrer | 93/37 SP |

*Primary Examiner*—Gerald A. Dost
*Attorney, Agent, or Firm*—Huebner & Worrel

[57] ABSTRACT

An apparatus having a form removably receivable in a carton or the like to maintain the carton in rigidly erect condition, and a frame having side portions bounding an internal receptacle dimensioned to receive the carton in removably fitted relation therein and the side portions having corresponding edges delineating a course along which the carton is severed to convert the carton to a preselected configuration.

4 Claims, 4 Drawing Figures

APPARATUS FOR CONVERTING A CARTON OR THE LIKE INTO A PRESELECTED CONFIGURATION

BACKGROUND OF THE INVENTION

1. Field of the Invention:

The present invention relates to an apparatus for converting a carton or the like into a preselected configuration and more particularly to such an apparatus which has particular utility in the formation of children's blocks from standard cartons, such as those in which milk and other beverages are sold, permitting such cartons readily to be converted to such a useful purpose by children themselves.

2. Description of the Prior Art:

Children are attracted to cartons of a variety of types, once empty, as articles with which to play. Particularly milk cartons are attractive to children perhaps because of their availability, light weight and relative rigidity. Such cartons are often used as toy houses or other objects during play.

Children's building blocks possess entertainment value and assist in developing their manual dexterity and other motor skills. Where such blocks bear indicia such as letters of the alphabet, numbers, pictures of animals or the like, the use of such blocks has educational value in familiarizing the children with such indicia. The value of the blocks would be further enhanced where children could observe the blocks being formed and could, where of a sufficient stage of development, form the blocks themselves with or without the assistance of an adult. It has been known in the past specially to construct cartons, such as shown in the Marsh Pat. No. 3,190,532, which can be converted to form building blocks. However, insofar as the applicant is aware there has not heretofore been a device which permits the conversion of conventional milk cartons and the like to preselected configurations such as building blocks. Therefore, it has long been known that it would be desirable to have an apparatus which permits conventional cartons and the like to be converted into preselected configurations, such as children's building blocks, dependably and with a simplicity permitting children themselves to achieve this conversion.

SUMMARY OF THE INVENTION

Accordingly, it is an object of the present invention to provide an apparatus for converting a carton into a preselected configuration.

Another object is to provide such an apparatus which encourages the recycling of used cartons to a new and beneficial use.

Another object is to provide such an apparatus which permits conventional cartons, such as those in which milk is sold, to be converted to form children's building blocks having a strength and durability permitting a long and useful life.

Another object is to provide such an apparatus which can be employed with such dependability and simplicity of operation that children themselves can use the apparatus in converting the cartons into building blocks.

Another object is to provide such an apparatus which encourages the development of motor skills in children while affording a high degree of entertainment value.

Another object is to provide such an apparatus which is inexpensive to produce and sell and yet which possesses a structure having a long operational life.

Another object is to provide such an apparatus which has provision for marking the carton in preselected locations for the subsequent application of indicia to the exterior of the building block so formed.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
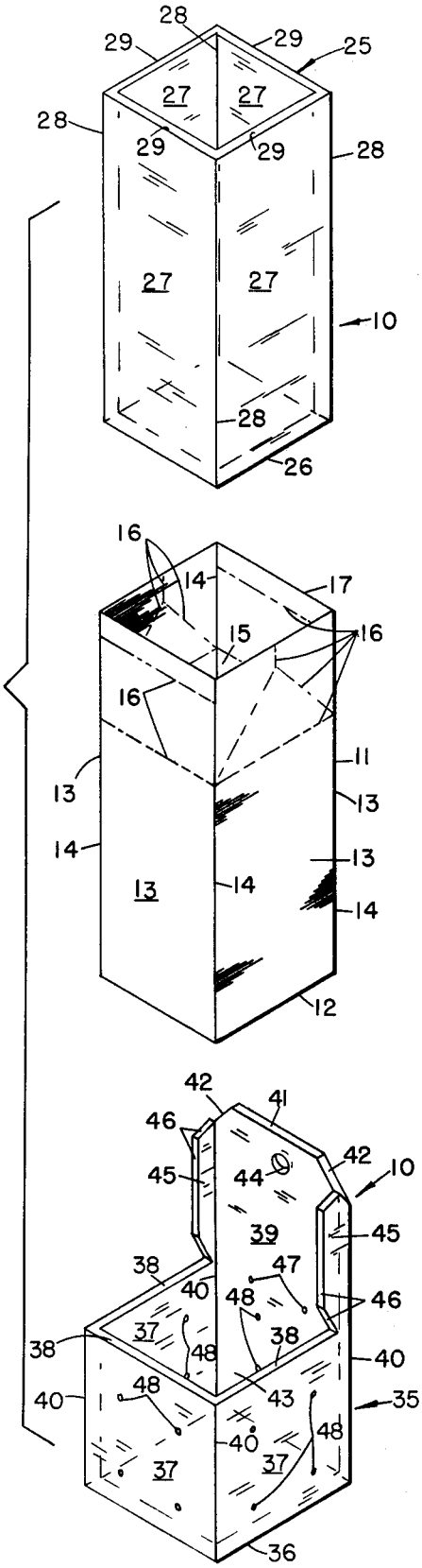
FIG. 1 is a perspective view of the apparatus of the present invention with the components thereof separated and with a carton aligned therebetween for convenience in illustrating the operational assembly of the components of the apparatus.

Referring more particularly to the drawing, the apparatus of the present invention is generally indicated by the numeral 10 in FIG. 1. As shown in that view, a carton, such as a conventional empty milk carton, is generally indicated at 11. The carton 11 has a bottom wall 12 integral with four right-angularly related side walls 13 mutually disposed at right angles to the bottom wall 12 of the carton. Adjacent side walls are joined at corners 14 and define an internal receptacle 15 for the carton. As shown in FIG. 1, the carton has a plurality of fold lines 16 on the side walls remote from the bottom wall along which the side walls are folded to form an upper closure 17 when the carton is sealed during production to enclose its contents. It will be understood that after the carton is emptied, the upper closure 17 is opened to the configuration shown in FIG. 1 to permit the apparatus to be used as will hereinafter be described.

The apparatus 10 has a form 25 which can be constructed of any suitable material such as rigid transparent plastic, metal, wood, or the like. The form has a bottom wall 26 integral with four upstanding side walls 27 orthogonally related to the bottom wall. Adjacent side walls are joined at corners 28 and the side walls have upper edges 29 remote from the bottom wall 26. The side walls and bottom wall are dimensioned to be received in the internal receptacle 15 of the carton 11 in removably fitted relation, such as shown in FIG. 2.

The apparatus 11 further includes a frame or housing 35 which, as with the form 25, can be constructed of any suitable material. The housing has a bottom wall 36 integral with three upstanding, orthogonally related side walls 37 individually having upper edges 38 disposed in a substantially common plane substantially parallel to the bottom wall 36 of the housing. The housing has a fourth side wall 39 integral with the bottom wall 36 and right-angularly related thereto. Adjacent side walls 37 and 39 are joined to form corners 40. The fourth side wall has a remote upper edge 41 which is preferably somewhat more than twice the distance from the bottom wall as the upper edges 38 are from the bottom wall. The fourth side wall has beveled corners 42 joining the remote upper edge 41, as best shown in FIG. 1.

Figure 2:
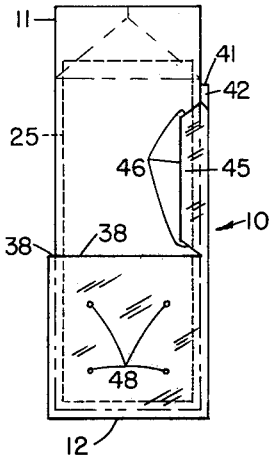
FIG. 2 is a side elevation of the assembled apparatus wherein the components are fitted together with a carton captured therebetween.

The bottom wall 36 and side walls 37 and 39 of the housing 35 form an internal receptacle 43 for the housing which is dimensioned to receive the carton 11 in removably fitted relation therein with the bottom wall 12 of the carton disposed in facing engagement with the bottom wall 36 of the housing, as shown in FIG. 2. A hole 44 is provided in the fourth side wall adjacent to the remote upper edge 41 of the side wall.

A pair of side members 45 are mounted on the fourth side wall 39 individually extending between the side walls 37 joining the fourth side wall and the beveled corners 42 of the fourth side wall, as best shown in FIG. 1. The side members individually have edges 46 which define flap portions, as will hereinafter be described. A pair of fold line holes or apertures 47 are provided in the fourth side wall defining a line extending between the points of juncture of the side walls 37 with the fourth side wall 39, as best shown in FIG. 1. In the preferred embodiment each of the side walls 37 and 39 has a plurality of indicia positioning holes or apertures extending therethrough. The apertures are individually positioned in their respective side walls to define positions for the location of indicia on the side walls 13 of the carton subsequent to conversion of the carton, as will hereinafter be described.

Figure 3:
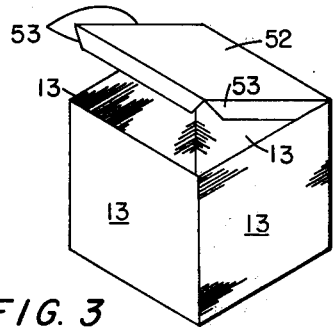
FIG. 3 is a perspective view of a carton after removal from the apparatus and severing to form a lid portion.
Figure 4:
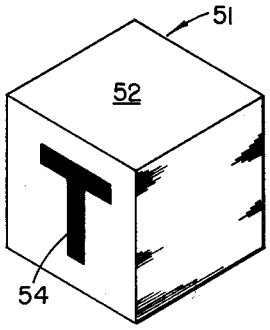
FIG. 4 is a perspective view of a building block constructed from a carton using the apparatus of the present invention.

Referring more particularly to FIGS. 3 and 4, a building block is generally indicated at 51 and constitutes the converted carton 11 subsequent to use of the apparatus 10. The building block has a lid portion 52 from which are extended three flap portions 53. As shown in FIG. 4, indicia are indicated at 54 affixed to the block. Of course, any suitable indicia could be employed such as letters of the alphabet, numbers, figures of animals and the like.

OPERATION

The operation of the described embodiment of the subject invention is believed to be clearly apparent and is briefly summarized at this point. When a carton 11, such as a milk carton, has been emptied of its contents, the upper closure 17 thereof is opened to the attitude shown in FIG. 1 to expose the internal receptacle 15 thereof. Subsequently the form 25 is slidably fitted within the internal receptacle of the carton 11 with the bottom wall 26 of the form disposed in facing engagement with the bottom wall 12 of the carton. Similarly, the four side walls 27 of the form individually facingly engage the side walls 13 of the carton. Thus, the form 25 retains the carton in rigidly erect relation.

Subsequently the form 25 bearing the carton 11 is disposed in fitted relation within the internal receptacle 43 of the housing 35 so that the bottom wall 12 of the carton is captured between the bottom wall 26 of the form and the bottom wall 36 of the housing, as best shown in FIG. 2. Similarly, the side walls 13 of the carton are individually captured between corresponding side walls 27 of the form and the side walls 37 and 39 of the housing. As can best be seen in FIG. 2, the fourth side wall 39 extends above the plane defined by the upper edges 38 of the side walls 37 of the housing in facing engagement with one of the side walls 13 of the carton. Similarly, the side members 45 individually engage the side walls 13 of the carton above the plane defined by the upper edges 38 of the three side walls 37.

The operator, preferably using a pencil or the like, marks the side walls 13 of the carton 11 by motivating the pencil along the course defined by the upper edges of the side walls 37, the edges 46 of the side members 45, the beveled corners 42 and remote upper edge 41 of the side wall 39. Similarly, the carton is marked by insertion of the pencil through the fold line apertures 47 and the indicia positioning apertures 48. During this operation, the form acts to retain the side walls of the carton in position to assist in this marking operation.

Thereafter, the form 25 is removed from the internal receptacle 15 of the carton 11 and the housing 35 is removed from the exterior of the carton. The carton is then severed along the courses marked on the carton to form the lid portion 52 of the building block 51 bearing the flap portions 53 thereof. The flap portions 53 are folded into substantially right-angular relation to the lid portion 52, as shown in FIG. 3, and the lid portion is folded along a fold line defined by the markings made through the apertures 47. Using a suitable adhesive, the flap portions are inserted within the side walls 13 of the carton and adhesively engaged therewith to retain the lid portion 52 in substantially right-angular relation to the side walls 13 thereof.

The building block 51 thus formed is shown in FIG. 4. Any suitable indicia 54 can be adhesively applied to the side walls of the carton using the markings formed on the side walls through the apertures 48 of the housing. Similarly, the block can be painted in any suitable color to obscure the advertizing visible on the carton and to present a pleasing appearance. The block can additionally be coated with a plastic substance such as Varithane or the like to impart greater strength to the building block, although this is not required.

Therefore, the apparatus of the present invention permits the conversion of conventional cartons into preselected configurations such as building blocks with a dependability and simplicity sufficient to permit children to use the apparatus and additionally providing utility to cartons which would otherwise be discarded.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An apparatus for converting a milk carton or the like, having a bottom wall integral with four upstanding, substantially right-angularly related side walls bounding an internal receptacle, into a child's block having substantially parallel end walls interconnected by four substantially right-angularly related side walls, the apparatus comprising:

A. a rigid form having a bottom wall and four substantially right-angularly related exterior surfaces arranged for individual facing engagement with the side walls of the milk carton when the form is fitted within said internal receptacle of the milk carton to retain the milk carton in rigidly erect condition and at least one of said surfaces of the form extending to a predetermined edge remote from said bottom wall;

B. a rigid housing having a bottom wall substantially normal to and integral with four substantially right-angularly related side walls bounding an interior dimensioned to receive the milk carton, having said form fitted therewithin, in nested relation therein and in abutting engagement with the bottom wall of said housing, three of said side walls of the housing having edges remote from the bottom wall of the housing and disposed in a plane substantially parallel to said bottom wall and the fourth of said side walls of the housing extending to a remote edge spaced from said plane a distance not less than the distance from the bottom wall of the housing to the plane; and C. a pair of said members borne by the fourth side wall of the housing between said plane and the remote edge of the fourth side wall, disposed for individual facing engagement with side walls of the milk carton in right-angular relation to the fourth side wall of the housing when the milk carton is received in said nested relation in the housing, and the side members having edges interconnecting edges of the side walls of the housing in said plane and the remote edge of the fourth side wall of the housing whereby the milk carton can be marked along said edges to delineate courses for severing of the milk carton in said converting of the milk carton to a child's block.

2. The apparatus of claim 1 wherein at least one side wall of the housing has a plurality of perforations extended therethrough at points positioned for designating on a side wall of the milk carton a location for indicia on said side wall of the milk carton when converted into the child's block.

3. An apparatus for use in converting a milk carton or the like into a block like article formed by a closure of a lid portion, the apparatus comprising a housing having side walls rigidly interconnected for individual engagement with side walls of the milk carton along three courses disposed substantially in a common plane and along a fourth course spaced from said plane to define said lid portion for the article therebetween; and a rigid form dimensioned to be disposed within said housing with said milk carton captured therebetween and operable to serve as a backing for the milk carton for marking of the carton along said courses to delineate courses for severing of the milk carton in converting it to form the article.

4. The apparatus of claim 3 including means borne by the housing between the plane and said fourth courses defining courses delineating flaps for the milk carton to be used in forming said article.

* * * * *